US007148842B1

(12) United States Patent
Crowne et al.

(10) Patent No.: US 7,148,842 B1
(45) Date of Patent: Dec. 12, 2006

(54) FERROELECTRIC DELAY LINE BASED ON A DIELECTRIC-SLAB TRANSMISSION LINE

(75) Inventors: Frank Crowne, Laurel, MD (US); Steve C. Tidrow, Silver Spring, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 81 days.

(21) Appl. No.: 10/769,850

(22) Filed: Feb. 3, 2004

Related U.S. Application Data

(63) Continuation-in-part of application No. 10/361,563, filed on Feb. 11, 2003, now abandoned.

(51) Int. Cl.
*H01P 9/00* (2006.01)

(52) U.S. Cl. ..... 342/175; 342/375

(58) Field of Classification Search ..... 342/175
See application file for complete search history.

(56) References Cited

U.S. PATENT DOCUMENTS

| | | | | | |
|---|---|---|---|---|---|
| 2,828,470 | A * | 3/1958 | Mason | 333/147 |
| 5,212,463 | A * | 5/1993 | Babbitt et al. | 333/161 |
| 5,409,889 | A * | 4/1995 | Das | 505/210 |
| 5,479,139 | A * | 12/1995 | Koscica et al. | 333/18 |
| 5,679,624 | A * | 10/1997 | Das | 505/210 |
| 5,830,591 | A * | 11/1998 | Sengupta et al. | 428/701 |
| 5,940,030 | A * | 8/1999 | Hampel et al. | 342/372 |
| 6,333,719 | B1 * | 12/2001 | Varadan et al. | 343/787 |
| 6,377,142 | B1 * | 4/2002 | Chiu et al. | 333/238 |
| 6,377,217 | B1 * | 4/2002 | Zhu et al. | 343/700 MS |
| 6,587,076 | B1 * | 7/2003 | Fujii et al. | 342/372 |
| 2003/0146806 | A1 * | 8/2003 | Nuecther et al. | 333/156 |

OTHER PUBLICATIONS

"Adaptive ferroelectric phase shifters for phased array antenna." Peng Thian Teo; Jose, K.A.; Gan, Y.B.; High Performance Electron Devices for Microwave and Optoelectronic Applications, 1999. EDMO. Nov. 22-23, 1999 pp. 182-187.*

DiDomenico, M and Pantell, R.H. "An X-Band Ferroelectric Phase Shifter". IEEE Transactions on Microwave Theory and Techniques. May 1962. vol. 10, Issue 3. pp. 179-185.*

* cited by examiner

*Primary Examiner*—Thomas H. Tarcza
*Assistant Examiner*—Matthew Barker
(74) *Attorney, Agent, or Firm*—Edward L. Stolarun

(57) ABSTRACT

A delay line is made by sandwiching a thin slice of ferroelectric between two "cladding" layers of relatively low-ϵ, low loss material to form a dielectric slab waveguide, and may support the propagation of electromagnetic guided waves and hence be used as a source of electric-field tunable time delay. There is a frequency range within which a dielectric-slab delay line behaves like a homogeneous transmission line with an "average" dielectric constant that is much lower than that of the ferroelectric, thereby ameliorating the difficulty with the high dielectric constant of the ferroelectric material. The thin slice of ferroelectric material "expels" a large fraction of the wave electric field, causing most of it to occupy the low-loss cladding material, greatly reducing the propagation loss along the delay line while allowing delay time to be varied by applying an electric-field through the ferroelectric within the cladding structure.

23 Claims, 5 Drawing Sheets

Phase shift vs. frequency for delay line

Experimental phase shift vs. frequency for delay line

Abscissa: 1 GHz/div, ordinate: 10 degrees/div.

FERROELECTRIC DELAY LINE BASED ON A DIELECTRIC-SLAB TRANSMISSION LINE

REFERENCE TO RELATED APPLICATIONS

This is a continuation-in-part application of application Ser. No. 10/361,563 filed Feb. 11, 2003 now abandoned.

STATEMENT OF GOVERNMENT INTEREST

The invention described herein may be manufactured and used by or for the United States Government for governmental purposes without the payment of any royalties thereon.

FIELD OF THE INVENTION

The present invention relates to a ferroelectric delay line. In particular, the present invention is directed toward a ferroelectric electric-field variable delay line based on a dielectric-slab transmission line.

BACKGROUND OF THE INVENTION

Due to its lack of moving parts and potential for conformal installation on vehicles, missiles and aircraft, the electrically scannable (E-scan) antenna is an important weapon in the arsenal of the Army's Future Combat Systems.

Most approaches to designing such antennas involve some type of phased array, in which the antenna beam is created by superimposing the outputs of many antenna subelements. Steering this beam is implemented by phase-shifting the input signals to these antenna elements relative to one another via phase shifters. The use of these phases shifters for beam steering has made it imperative that a simple, low-cost method be identified for electrically controlling them. However, existing approaches to designing phased-array antennas involves complicated sub-circuits with mixers, amplifiers, and the like, feeding each antenna element. Such circuitry makes the radius complicated, unreliable, and expensive to manufacture and maintain.

Recent work at the Army Research Lab on E-scan antennas as part of the Multifunction RF STO has centered on two architectures for such passed arrays: one based on the use of hundreds of discrete phase shifters, one for each antenna subelement, and the other a "true-time delay" approach in which a single tapped delay line is used to generate and phase all the signals sent to the antenna array elements at the same time.

In the true time-delay approach, a time-dependent input signal is launched as a wave on a waveguide. Electrodes ("taps") placed along the waveguide at equal intervals generate replicas of this input signal that are delayed relative to one another by the time the wave takes to go from one tap to another. In contrast to the discrete phase shifter approach, with its hundreds of elements, this approach makes possible the simultaneous generation of as many signals as are needed from a single monolithic element, the waveguide. When used in this fashion, the waveguide is referred to as a "delay line".

Some delay lines have the property that the delays imposed on the signal replicas appearing at its taps are the same regardless of the underlying signal frequency (in the art such a line is said to be "non-dispersive"). When this is true, even complex time-dependent signals consisting of many frequencies (so-called "broadband" signals) can be used to steer antenna beams in one direction without drifting or unintentional scanning. In contrast, the discrete phase shifter approach restricts the complexity of input signals lest they interfere with the steering in the specified direction, which makes them useless for sophisticated radar applications.

In order to electrically steer the antenna, it is necessary to electrically control the phase shifts imposed on the signal replicas sent to the antenna elements. It has long been known that electrically controllable phase shifters can be made by using ferroelectric materials, by virtue of the nonlinear dielectric response of the latter. Combining this choice of materials with the true-time delay approach leads to the novel concept of an electrically controllable delay line. Such a line can support the propagation of a signal along it like any other delay line, and can be tapped in the same way, leading to phase shifts between the taps. The choice of dielectric determines how much delay is obtained per length of line.

However, if the dielectric used to make the line is also a ferroelectric, the line properties can be changed by "biasing" it with a DC voltage. The simplest way to implement such a line is to make it a microstrip, consisting of a ferroelectric layer on top of a metal ground plane with a narrow strip of metal on top of the ferroelectric layer. The input signal propagates along this metal strip as a voltage between the top conductor and the ground plane. This type of line is non-dispersive as defined above, so that complex signals can be used with it. In addition to this signal, a DC bias can be applied in the same way. Because the bias changes the RF propagation velocity, the delay, and hence the phase shift, can be controlled by the bias. This control applies to all the multiple versions of the signal obtained from the taps, i.e., all the phase shifts are controlled by a single DC bias. In principle, one delay line could steer an entire antenna array.

Unfortunately, such use of ferroelectrics is not without problems. Because dielectric constants are extremely high in these materials, the wavelengths of electromagnetic waves that propagate in them are very short, which leads to "too much" phase shift per centimeter of line. In addition, the loss per centimeter down the line is extremely high.

It can be shows that in order for a phased array antenna fed by a delay line to generate a strong main beam, the distance between delay line taps D must satisfy the relation $$\frac{D}{d}\sqrt{\varepsilon} < 1,$$

where d is the spacing between antenna array subelements. Because d is commonly chosen to be $\lambda/2$, where $\lambda$ is the free-space wavelength of the radar signal and is typically a few centimeters down to a millimeter for military applications, working with a ferroelectric in which $\epsilon$ is, e.g., 1000 requires values of $D<d/30$, i.e., the delay line taps must be extremely close together.

These parameters make a microwave-based delay line using ferroelectrics difficult to manufacture. In addition, the dielectric constant of a pure ferroelectric material is extremely sensitive to temperature, and typically is lossy as well, which may distort the shape of the antenna beam and produce unintended beam motion.

SUMMARY OF THE INVENTION

The problems described above can all be solved by using the delay line of the present invention, which is made by sandwiching a thin slice of ferroelectric vertically between two "cladding" layers of relatively low-ϵ, low loss material. This type of structure, referred to as a dielectric slab waveguide in the art, can support the propagation of electromagnetic guided waves like an ordinary microstrip, and hence can be used as a source of phase delay.

In general, the characteristics of this propagation are more complex than those of a simple microstrip (see Ref. 1). However, according to the present invention, there is a frequency (determined by proper choice of materials and geometry) below which this dielectric-slab wave guide behaves like a simple microstrip line, i.e., a metal strip over a uniform dielectric, with an "average" dielectric constant. Because this average dielectric constant can be much lower than that of the ferroelectric, the difficulties associated with the high dielectric constant of the pure ferroelectric material can be overcome.

There are a number of advantages to the present invention. Because the structure "looks like" microstrip in the frequency range of interest, the delay it generates is almost frequency-independent as is the case for microstrip. Because the average dielectric constant can be made low, the delay line taps can be spaced farther apart, which prevents arcing from tap to tap under high-power operation. In addition, it can be shown that the thin slice of ferroelectric material "expels" the wave electric field into the low-loss cladding material, which greatly reduces propagation losses along the delay line.

In principle, a nondispersive delay line could be obtained by simply mixing the cladding and ferroelectric materials together to form a uniform composite, and then putting the microstrip on top. However, such a mixture of dielectric and ferroelectric would tend to be unresponsive to the dc bias applied to the top conductor, because the voltage will tend to be felt by only the non-turnable and low dielectric material due to parallel capacitance effects, which inhibits the control of the phase shift. In contrast, the invention described here forces most of the dc bias field to pass through the thin slice of undiluted ferroelectric, causing a large change in the dielectric response. This greatly extends the range of controllable phase shifts, and hence the steering capability of the line.

DETAILED DESCRIPTION OF THE INVENTION

Figure 1:
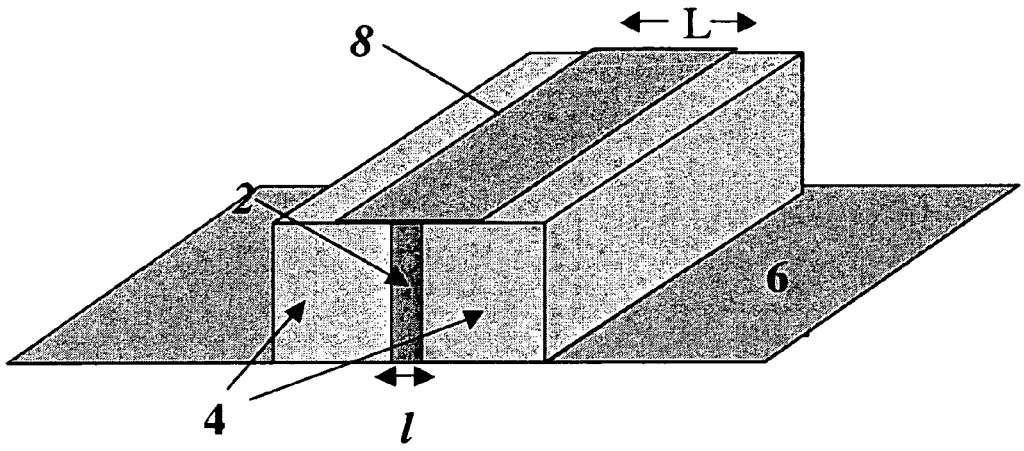
FIG. 1 is a perspective view of the dielectric-slab structure in its microstrip form.

With reference to FIG. 1, a ferroelectric layer 2 is placed between the vertical edges of two dielectric "cladding" layers 4, with all three layers resting upright on the ground plane 6. A metal strip 8 overlays the structure, covering the entire exposed edge of the ferroelectric 2 and a portion of the two cladding layers 4.

Figure 2A:
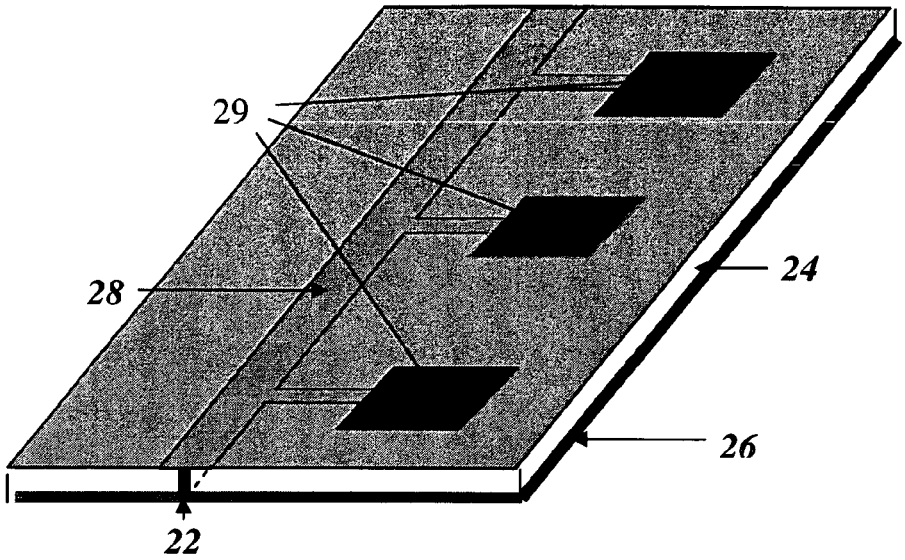
FIGS. 2*a* and 2*b* are perspective views illustrating two schemes for tapping the delay line of the preferred embodiment of the present invention and integrating it monolithically into an antenna array.
Figure 2B:
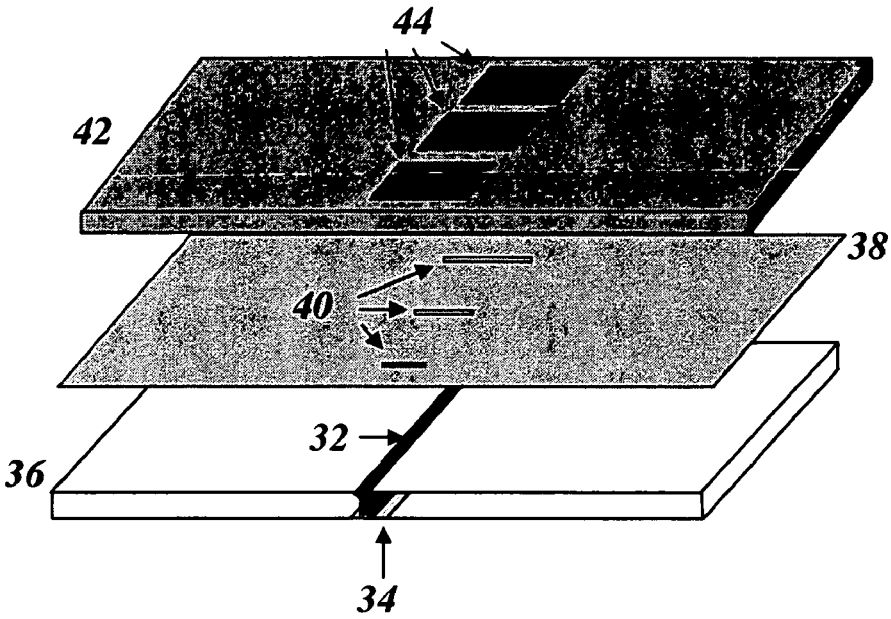

With reference to FIG. 2(*a*), the ferroelectric layer 22 is sandwiched between the two cladding layers 24 and rests with them on the ground plane 26. The metal strip with taps 28 carries the input signal and distributes it along the taps to the patch antennas 29. In FIG. 2(*b*) the structure is flipped upside down, with the ferroelectric layer 32 contacting the metal strip 34 on the underside of the cladding-plus-ferroelectric structure 36, which is labeled "dielectric 1". The ground plane 38, which is now on top of the structure, is pierced by apertures 40 that allow the signal to penetrate a second dielectric layer 42, which is labeled "dielectric 2". On this dielectric layer a patch antenna 44 is placed directly over each aperture 40, from which it receives signal power.

The ferroelectric delay line consists of two plates of relatively low-dielectric constant, low-loss material (henceforth referred to as "cladding") placed edge-to-edge, with a thin slice of high-dielectric constant (ferroelectric) material inserted between their adjacent edges so that the entire structure forms a horizontal "sandwich", and a metal strip placed on top of the juncture that covers the "top" of the ferroelectric layer and a predetermined amount of the cladding on both sides of the juncture, with the entire structure resting on a metal plate (henceforth referred so as the "ground plane").

This structure forms a laterally nonuniform microstrip transmission line that supports propagation of electromagnetic guided waves, which waves become a source of time delay and phase shift for signal processing and phased array antennas. The properties of these electromagnetic waves are discussed in detail in Ref. [1]. Here, we note that at low frequencies they propagate with a velocity that is frequency independent and given by $$v = \frac{c}{\sqrt{\varepsilon_{eff}}},$$

where $\epsilon_{eff}$ is an effective dielectric constant given by the formula $$\varepsilon_{eff} = \varepsilon_{ferro}\frac{l}{L} + \varepsilon_{clad}\left(1 - \frac{l}{L}\right)$$

where l is the width of the ferroelectric and L is the width of the microstrip metal on top of it.

Because the propagation velocity is frequency independent, the signal delay generated by the ferroelectric delay line is also frequency-independent up to a certain maximum signal frequency, allowing the time delay, phase shifting and processing of complex radar signals without distortion and the accurate steering of antenna beams. The delay provided by this delay line can be controlled by a dc bias voltage applied between the microstrip metal and the ground plane.

The ferroelectric properties of the thin layer force substantially all of the DC bias field to pass through the thin slice of undiluted ferroelectric, causing the induced change in the dielectric response to be large, extending the range of a controllable time delay and phase shift and hence the steering/processing capability of the line.

The thin slice of ferroelectric material expels a sizable fraction of the wave electric field into the two cladding layers of relatively low-ϵ, low loss material, greatly reducing losses in a signal propagating along the ferroelectric delay line.

The maximum frequency at which the line provides a frequency-independent delay can be specified by the designer based on his choice of materials and geometry. Specifically, if the ferroelectric material dielectric constant is [68] ferro and the cladding dielectric constant is [68] clad, a delay line with a metal microstrip line of width L and a ferroelectric layer of width l will have a maximum frequency of useful operation given by the expression:

$$f_c = \frac{c}{l} \cdot \frac{\sqrt{6}}{\pi} \frac{\sqrt{\varepsilon_{ferro}\frac{l}{L} + \varepsilon_{clad}\left(1 - \frac{l}{L}\right)}}{\left(1 - \frac{l}{L}\right)(\varepsilon_{ferro} - \varepsilon_{clad})}$$

Multiple electrical connections are made to the ferroelectric delay line along its length. In operation, these connections (henceforth referred to as "taps") allow multiple outputs from the delay line, each of which is a version of an input signal delayed by an amount determined by the geometric location of the tap it is taken from.

The relatively low-dielectric, low loss cladding material may consist of any one of numerous materials including but not limited to quartz, alumina, MgO, $LaAlO_3$, and LSAT.

To illustrate how the ferroelectric delay line of the present invention operates, suppose that a harmonic signal with frequency ω is applied to the input end of the delay line (See, e.g., FIG. 2). Then the same signal appears at the nth tap, having acquired a phase $n\Delta\phi_D$, where $$\Delta\phi_D = \frac{\omega}{\upsilon} D,$$

where D is the spacing between taps and ν is the wave propagation velocity in the line.

This signal may then be fed to a radiating element in the antenna, with the delay-line phase added to the far-field antenna-pattern phase $$\Delta\phi_A = -\frac{\omega}{c} d\sin\theta,$$

where d is the spacing between radiators, and θ is the azimuthal angle with respect to boresight and c is the velocity of light in vacuum. Then the signal radiated by the nth element has a net phase of $$n(\Delta\phi_D + \Delta\phi_A) = n\frac{\omega}{\upsilon}\left(D - \frac{\upsilon}{c} d\sin\theta\right).$$

The electromagnetic fields of N of these radiators combine to give rise to the far-field pattern of the antenna, i.e., $$P(\sin\theta) = \frac{\sin\frac{N}{2}(\Delta\phi_D + \Delta\phi_A)}{\sin\frac{1}{2}(\Delta\phi_D + \Delta\phi_A)} = \frac{\sin\frac{N}{2}\frac{\omega}{\upsilon}\left(D - \frac{\upsilon}{c} d\sin\theta\right)}{\sin\frac{1}{2}\frac{\omega}{\upsilon}\left(D - \frac{\upsilon}{c} d\sin\theta\right)}.$$

It is clear from this expression that the main beam will be radiated at an angle at which the quantity $$\frac{N}{2}\frac{\omega}{\upsilon}\left(D - \frac{\upsilon}{c} d\sin\theta\right)$$

vanishes, given by the relation $$D - \frac{\upsilon}{c} d\sin\theta = 0 \tag{3}$$

Since electromagnetic waves in a delay line propagate at a velocity $$\upsilon = \frac{c}{\sqrt{\varepsilon}},$$

where ε is the dielectric constant, one can write $$P(\sin\theta) = \frac{\sin\frac{N}{2}\frac{\omega}{c}\left(D - \frac{d}{\sqrt{\varepsilon}}\sin\theta\right)}{\sin\frac{1}{2}\frac{\omega}{c}\left(D - \frac{d}{\sqrt{\varepsilon}}\sin\theta\right)}$$

and (3) becomes $$D\sqrt{\varepsilon} = d\sin\theta$$

When $$\frac{D}{d}\sqrt{\varepsilon} < 1,$$

this equation can be satisfied at a specific angle $\theta_c$. At this angle the main-lobe intensity is N times that of a single radiator. When it is not satisfied, the pattern degenerates into a weak collection of so-called "grating lobes" due to destructive interference. Note that if ε is frequency-independent, the main lobe orientation is also frequency-independent, so that broadband signals will not be subject to distortion due to frequency scanning. At the same time, the field dependence of ε allows the beam to be steered by varying the dc bias.

In a sample design of the present invention, assume the delay line has nine elements feeding nine radiators. At a frequency of 10 GHz, the wavelength is 3 cm in free-space. Typically, the antenna elements are separated a half-wavelength (1.5 cm) apart. Let the zero-field dielectric constant $\varepsilon_{eff}$ be 30; then the wavelength $\lambda_F$ in the ferroelectric is 5.47 mm. The equation $$\frac{D}{d}\sqrt{\varepsilon_{eff}} = \sin\theta_C$$

can only be satisfied if the spacing $$D < \frac{d}{\sqrt{\varepsilon_{eff}}} = \frac{\lambda}{2\sqrt{\varepsilon_{eff}}} = \frac{\lambda_F}{2} = 2.73 \text{ mm.}$$

mm. For D=2 mm this gives $\theta_C$=47° of beam deflection. The total length of a line with 9 such taps would be 1.8 cm, or about 0.7 inch.

Figure 3:
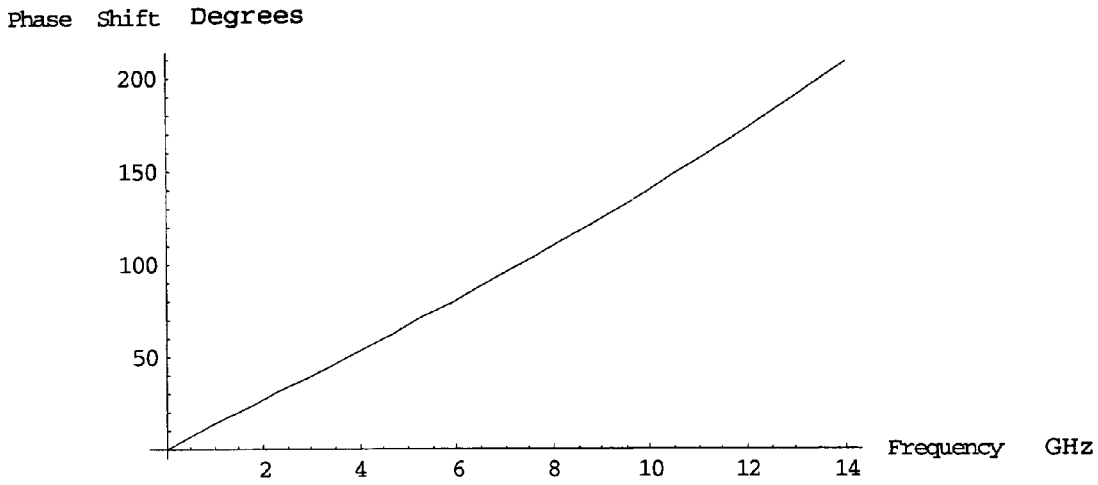
FIG. 3 is a graph illustrating the phase shift versus frequency for a line designed to operate around 10 GHz.

If the dielectric constant drops to 20 under an applied DC electric field, the new wavelength in the ferroelectric will be 4.47 mm. Then $$\frac{D}{d}\sqrt{\varepsilon_{eff}} = \sin\theta_C$$

gives $\theta_C$=37°. Thus, the beam scans through 10° at the center frequency. In FIG. 3 we show the calculated phase shift versus frequency for a line designed to operate around 10 GHz. Here the cladding has $\epsilon_{clad}$=4 (about that of quartz) and the ferroelectric is tunable in the range $\epsilon_{ferro}$=256–400. We obtain a value $\epsilon_{eff}$=30 at zero field, i.e., for $\epsilon_{ferro}$=400, by choosing a very thin (3.3 mils) layer of ferroelectric material beneath a microstrip that covers 50 mil of cladding. At the lowest value $\epsilon_{ferro}$=256 we find that $\epsilon_{eff}$=20. At zero field, the phase shift per tap is 190 degrees, and is seen to be quite linear with frequency from zero up to 14 GHz.

A further similarity between this structure and an optical fiber is that in both cases, the fields are confined by total reflection of the electromagnetic wave inside the ferroelectric at the dielectric interfaces, leading to the characteristic "zigzag" ray picture of confined laser and fiber modes described in texts on optoelectronics. Like a fiber, this structure has only a finite number of propagating modes at a given frequency. For the example given here, the next higher mode is at 157 GHz, i.e., too high to be a problem.

Thus, the present invention discloses several features that are neither anticipated by, nor rendered obvious by the teachings of the prior art. Among these features are:

- The use of wave propagation to create a monolithic source of true time delay for phasing an entire antenna array and utilize a reduced number of voltage control lines In contrast to standard collections of discrete phase shifters, and unlike other layered dielectric-ferroelectric structures reported in the literature [HUDSON PATENT], this source allows a common bias to generate many different phase shifts.
- The insertion of a ferroelectric layer into a cladding structure for purposes of wave guiding, by analogy with optical fibers.
- The use of ferroelectric in dielectric-slab cladding structure as a source of electric-field variable signal delay.
- The choice of low-loss, low-dielectric constant cladding materials to avoid materials problems, dispersion, with ferroelectrics.

Figure 4:
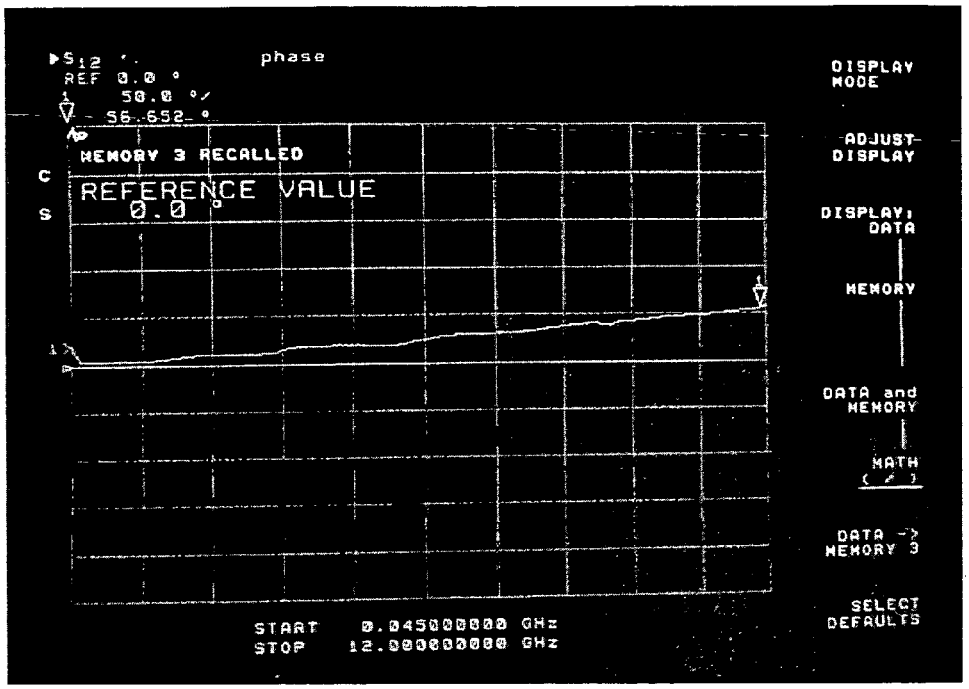
FIG. 4 is a graph of experimental data illustrating relative phase shift versus frequency for a ferroelectric in cladding structure for an electric-field strength of about 2 V/μm.

FIG. 4 is a graph of experimental data illustrating relative phase shift versus frequency for a ferroelectric in cladding structure (untapped delay line) at a bias electric-field strength of about 2 V/μm. The linear progression of phase shift versus frequency (0.045 GHz to 12.0 GHz) is indicative of the broadband true time delay nature of the ferroelectric-in-cladding delay line. The small nonlinear departures from linear behavior at about 1.7 GHz intervals, corresponding to the effective electrical length being nλ/4 of the radiation wavelength, occur because no special attempts were made to impedance match the device. The time delay of the device, FIG. 4, is about 333 ps/cm with variable time delay of about 22 ps/cm and 2 V/μm at room temperature.

Although the present invention is disclosed in terms of delay lines for a phased-array antenna, the delay line of the present invention has applications in related electronic fields. Structures based on delay lines are common in electronics. The structure described here may also be used in conjunction with SAW (surface-acoustic-wave), transverse, and other types of filters, correlators, and reflection-array compressors for use in signal processing.

While the preferred embodiment and various alternative embodiments of the invention have been disclosed and described in detail herein, it may be apparent to those skilled in the art that various changes in form and detail may be made therein without departing from the spirit and scope thereof.

REFERENCES

[1] F. J. Crowne and S. Tidrow, Mater. Res. Soc. Symposium Porc. Vol. 720, p. 185 (Material Research Soc., Warrendale, Pa., 2002).

What is claimed is:

1. A ferroelectric delay line based upon a dielectric-slab transmission line, comprising:

a ground plane;

a thin slice of ferroelectric material having one edge on said ground plane and an opposite edge spaced from and extending along said ground plane;

a pair of cladding layers of relatively low-ϵ, low loss material;

said thin slice of ferroelectric material sandwiched between said pair of cladding layers;

a metal strip overlaying and in contact with said opposite edge of said thin slice of ferroelectric material; and said metal strip also overlaying only a portion of each cladding layer adjacent said opposite edge to thereby form an open waveguide for supporting propagation of electromagnetic guided waves, which becomes a source of time delay and phase shift that is tunable by a DC bias electric field.

2. The ferroelectric delay line of claim 1, wherein the delay generated by the ferroelectric delay line is frequency-independent, allowing the time delay, phase shifting and transmission of complex radar signals without frequency scanning, because said dielectric-slab waveguide responds to signals below a predetermined frequency, determined by choice of materials and geometry, like a simple dispersionless microstrip line, that is, a metal strip over a uniform dielectric, whose dielectric constant is an average of the dielectric constants of the ferroelectric and cladding materials.

3. The ferroelectric delay line of claim 1, wherein the average dielectric constant of the ferroelectric delay line is relatively low, and further including a plurality of delay line taps extending from said metal strip which are spaced apart so as to prevent arcing from tap to tap under high-power operation.

4. The ferroelectric delay line of claim 3, wherein a harmonic signal with frequency ω is applied to an input end of the metal strip, the same harmonic signal appearing at an nth tap, having acquired a phase $n\Delta\phi_D$, where $$\Delta\phi_D = \frac{\omega}{\upsilon}D,$$

where D is the spacing between taps and ν is the wave propagation velocity in the line.

5. The ferroelectric delay line of claim 4 wherein the harmonic signal that appears at the nth tap can be used to feed the nth radiating element of an antenna, with the delay-line phase added to the far-field antenna-pattern phase $$\Delta\phi_A = \frac{\omega}{c}d\sin\theta,$$

where d is the spacing between radiators and θ is the azimuthal angle with respect to the antenna axis and c is the velocity of light in vacuum.

6. The ferroelectric delay line of claim 5, wherein the signal radiated by the nth radiating element has a net phase of $$n(\Delta\phi_D + \Delta\phi_A) = n\frac{\omega}{\upsilon}\left(D - \frac{\upsilon}{c}d\sin\theta\right).$$

7. The ferroelectric delay line of claim 6 wherein the electromagnetic fields of N of these radiators combine to give rise to the far-field pattern of the antenna whose main lobe is radiated at the angle at which the quantity $$\frac{N}{2}\frac{\omega}{\upsilon}\left(D - \frac{\upsilon}{c}d\cos\theta\right)$$

vanishes, i.e., where $$D - \frac{\upsilon}{c}d\sin\theta = 0.$$

8. The ferroelectric delay line of claim 7 wherein since electromagnetic waves in a delay line propagate at a velocity $$\upsilon = \frac{c}{\sqrt{\varepsilon}},$$

where ϵ is the dielectric constant, provided that ϵ is frequency-independent the relation $$D - \frac{\upsilon}{c}d\sin\theta = 0$$

implies that $$\theta_C = \sin^{-1}\left(\frac{D\sqrt{\varepsilon}}{d}\right),$$

defining a specific frequency-independent angle $\theta_C$ that the main lobe of the antenna pattern makes the antenna boresight, in which direction the radiated intensity is N times that of a single radiator, said frequency independence ensuring that broadband signals will not be subject to distortion due to frequency scanning while at the same time, the field dependence of ϵ allows the beam to be steered by varying the DC bias.

9. The ferroelectric delay line of claim 1 wherein the thin slice of ferroelectric material expels a sizable fraction of the wave electric field into the pair of cladding layers of relatively low-ϵ, low loss material, greatly reducing propagation losses having the ferroelectric delay line.

10. The ferroelectric delay line of claim 1, wherein substantially all of the DC bias field passes through the thin slice of ferroelectric material, causing a large change in the dielectric response so as to extend the range of controllable time delay and phase shift, and hence the steering capability of the line.

11. A ferroelectric delay line comprising:

two layers of a relatively low-dielectric and low loss material, a thin ferroelectric slab sandwiched between the two layers of relatively low-dielectric, low loss material, a metallic ground plane upon which the entire structure rests; and a strip of metal wide enough to cover and make both physical and electrical contact with a portion of the top of the structure, including all the ferroelectric slab and only a portion of the relatively low-dielectric and low loss cladding material on either side of it, to make an The ferroelectric delay line of claim 1, wherein the open microwave structure that is electrically active and tunable.

12. The ferroelectric delay line of claim 11, wherein the relatively low-dielectric, low loss cladding material may consist of any one of numerous materials including but not limited to quartz, alumina, MgO, $LaAlO_3$, and LSAT.

13. An antenna array, comprising a plurality of antenna elements; and at least two ferroelectric delay line, coupled to the plurality of antenna elements, said delay line being based upon a dielectric-slab transmission line consisting of a thin slice of ferroelectric material sandwiched between two cladding layers of relatively low-ϵ, low loss material to form a dielectric slab waveguide that supports the propagation of electromagnetic guided waves, thereby allowing it to act as a source of time delay and phase shifts to individual elements of the plurality of antenna elements, said dielectric-slab waveguide responding to signals below a predetermined frequency, determined by choice of materials and geometry, like a simple dispersionless microstrip line, that is, a metal strip over a uniform dielectric, whose dielectric constant is an average of the dielectric constants of the ferroelectric and cladding materials, thereby creating a monolithic source of true time delay for phasing the entire antenna array, wherein the ferroelectric delay line allows a common bias to generate many different time delays and phase shifts.

14. The antenna array of claim 13, wherein the delay generated by the ferroelectric delay line is frequency-independent, allowing the time delay, phase shifts and transmission of complex radar signals without frequency scanning.

15. The antenna array of claim 13, wherein the average dielectric constant of the ferroelectric delay line is relatively low, and further including a plurality of delay line taps which are spaced apart so as to prevent arcing from tap to tap under high-power operation.

16. The antenna array of claim 15 wherein a harmonic signal with frequency to applied to the input end of the delay line appears at the nth tap having acquired a phase $n\Delta\phi_D$, where $$\Delta\phi_D = \frac{\omega}{\upsilon}D,$$

D is the spacing between taps, and ν is the wave propagation velocity in the line.

17. The antenna array of claim 16 wherein the harmonic signal at an nth tap is fed to the nth radiating element in the antenna, with the delay-line phase added to the far-field antenna-pattern phase $$\Delta\phi_A = -\frac{\omega}{c}d\sin\theta,$$

where d is the spacing between radiators, θ is the azimuthal angle with respect to the antenna axis, and c is the velocity of light in vacuum.

18. The antenna array of claim 17, wherein the signal radiated by the nth radiating element has a net phase of $$n(\Delta\phi_D + \Delta\phi_A) = n\frac{\omega}{\upsilon}\left(D - \frac{\upsilon}{c}d\sin\theta\right).$$

19. The antenna array of claim 18, wherein since electromagnetic waves in a delay line propagate at a velocity $$\upsilon = \frac{c}{\sqrt{\varepsilon}},$$

where ϵ is the dielectric constant, provided that ϵ is frequency-independent the relation $$D - \frac{\upsilon}{c}d\sin\theta = 0$$

implies that $$\theta_C = \sin^{-1}\left(\frac{D\sqrt{\varepsilon}}{d}\right),$$

defining a specific frequency-independent angle $\theta_C$ that the main lobe of the antenna pattern makes with the antenna boresight, in which direction that radiated intensity is N times that of a single radiator, said frequency independence ensuring that broadband signals will not be subject to distortion due to frequency scanning while at the same time, the field dependence of ϵ allows the beam to be secured by varying the DC bias.

20. The antenna array of claim 13, wherein the thin slice of ferroelectric material expels a sizeable fraction of wave electric field into the two cladding layers of relatively low-ϵ, low loss material, greatly reducing propagation losses along the ferroelectric delay line.

21. The antenna array of claim 13, wherein the ferroelectric delay line forces substantially all of the DC bias field to pass through the thin slice of undiluted ferroelectric, causing a large change in the dielectric response which extends the range of controllable time delay and phase shifts, and hence the steering capability of the line.

22. The antenna array of claim 13, wherein the dielectric-slab structure comprises:

two layers of a relatively low-dielectric, low loss material;

a thin ferroelectric slab sandwiched between the two layers of relatively low-dielectric, low loss material;

a metallic ground plane upon which the entire structure rests; and a strip of metal wide sufficiently enough to cover and make both physical and electrical contact with a portion of the top of the structure, including all the ferroelectric slab and a predetermined amount of the relatively low-dielectric, low loss cladding material on either side of it, so as to make an open microwave structure that is electrically active and tunable.

23. The antenna array of claim 22, wherein the relatively low-dielectric, low loss material can consist of any one of numerous materials including but not limited to quartz, alumina, MgO, $LaAlO_3$, and LSAT.

* * * * *